US006176166B1

(12) United States Patent
Mattinger et al.

(10) Patent No.: US 6,176,166 B1
(45) Date of Patent: Jan. 23, 2001

(54) ELECTRIC HAIR CUTTING MACHINE WITH AN AUTOMATIC OIL LUBRICATING DEVICE

(75) Inventors: Detlef Mattinger, Bickenbach; Martin Liebeck, Darmstadt, both of (DE)

(73) Assignee: Wella Aktiengesellschaft, Darmstadt (DE)

( * ) Notice: Under 35 U.S.C. 154(b), the term of this patent shall be extended for 0 days.

(21) Appl. No.: 09/376,924

(22) Filed: Aug. 18, 1999

Related U.S. Application Data

(62) Division of application No. 09/014,275, filed on Jan. 27, 1998, now Pat. No. 5,970,831.

(30) Foreign Application Priority Data

Mar. 13, 1997 (DE) ..... 197 10 267
Apr. 23, 1997 (DE) ..... 197 17 055

(51) Int. Cl.[7] ..... B26D 7/00

(52) U.S. Cl. ..... 83/169; 83/522.11; 83/522.27; 30/41.7; 30/45

(58) Field of Search ..... 83/13, 522.11, 83/522.27, 169; 30/41.7, 45

(56) References Cited

U.S. PATENT DOCUMENTS 5,111,580 * 5/1992 Bosscha et al. ..... 30/41.7
5,600,888 * 2/1997 Becker ..... 30/41.7

FOREIGN PATENT DOCUMENTS 21 17 319 U * 10/1972 (DE) .

* cited by examiner

*Primary Examiner*—M. Rachuba
(74) *Attorney, Agent, or Firm*—Michael J. Striker

(57) ABSTRACT

The electric haircutting machine includes an electrical drive motor, cutting blades driven by the drive motor, a device (22) for oiling the cutting blades and a device (20) for detecting an oil deficiency of the oil lubricating the cutting blades. The device (22) for oiling the cutting blades is connected with and responsive to the device (20) for detecting the oil deficiency, whereby the device for oiling the cutting blades is automatically activated to oil the cutting blades when the oil deficiency is detected. The device for detecting the oil deficiency detects whether or not motor current consumption, cutting blade vibration noise, haircutting machine sound level, cutting blade temperature, force acting on one of the cutting blades or drive motor rotation speed exceeds a corresponding predetermined threshold or not in order to establish the presence or absence of the oil deficiency.

4 Claims, 3 Drawing Sheets

ELECTRIC HAIR CUTTING MACHINE WITH AN AUTOMATIC OIL LUBRICATING DEVICE

CROSS-REFERENCE

This is a division of application Ser. No. 09/014,275, filed Jan. 27, 1998 now U.S. Pat. No. 5,970,831.

BACKGROUND OF THE INVENTION

The present invention relates to a method and apparatus for detecting an oil deficiency of oil lubricating an electrically drive cutting blade in a haircutting machine.

The cutting blade of a haircutting machine usually must be oiled. If this does not take place, first the cutting power drops and later irreparable damage occurs to the cutting blade. Currently the user (hair stylist) of the haircutting machine decides subjectively whether the cutting blade should be oiled. There is however a certain degree of convenience in postponing this oiling process to a later time. Because of that in practice often the interval between oiling events is too great, which can cause the destruction of the cutting blade. This type of haircutting machine is, for example, disclosed in German Patent Application DE 21 17 319 A.

SUMMARY OF THE INVENTION

It is an object of the present invention to provide a process and apparatus for detecting an oil deficiency of oil lubricating an electrically drive cutting blade in a haircutting machine in order to avoid the above-described disadvantage.

In a haircutting machine the motor, for example, is usually arranged in a housing behind a cutting head so that it is connected with its drive shaft with a rotating cam with an eccentric pin. This eccentric pin moves a control and/or cam slit in order to convert the rotation of the pin into an oscillating motion of successive cutting blades following each other in a direction transverse to the axis of the pin. With a greatly reduced oil film between both cutting blades they begin to rub on each other so that the required applied force, in order to maintain the oscillations of the moving blades, climbs. Because of that, the motor current increases and the rotation speed decreases. Furthermore a greater amount of the energy input into the motor is converted into heat energy by the increased friction between the blades. This causes a sharp increase in the temperature gradient at the blades in the first minutes after the turning on the haircutting machine. Because of the friction of the blades on each other the oscillatory motion of the blades is non-periodically damped whereby the housing vibrations (body noise) and the noise level from the haircutting machine increase.

The present invention is based on the above-described understanding of the principles of operation of the haircutting machine.

In the method according to the invention a measured variable is measured during operation of the haircutting machine and whether or not the oil deficiency occurs is determined from the changes in the measured variable, preferably by comparing the selected measured value with a predetermined threshold to determine if the selected measured value is above or below the threshold for a predetermined time interval. The measured variable can be the drive motor current consumption, cutting blade vibration noise, haircutting machine sound level, cutting blade, temperature, forces acting on the cutting blades or thee drive motor rotation speed.

The apparatus for determining whether or not an oil deficiency has occurred or not includes means for detecting whether there is a deficiency in the oil lubricating the cutting blades by measuring the changes in on of the above-mentioned measured variables. In a preferred embodiment the apparatus also preferably includes means for signaling the occurrence of an oil deficiency and advantageously means for oiling the cutting blades, which is automatically activated when the means for detecting the oil deficiency determines that an oil deficiency has occurred.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
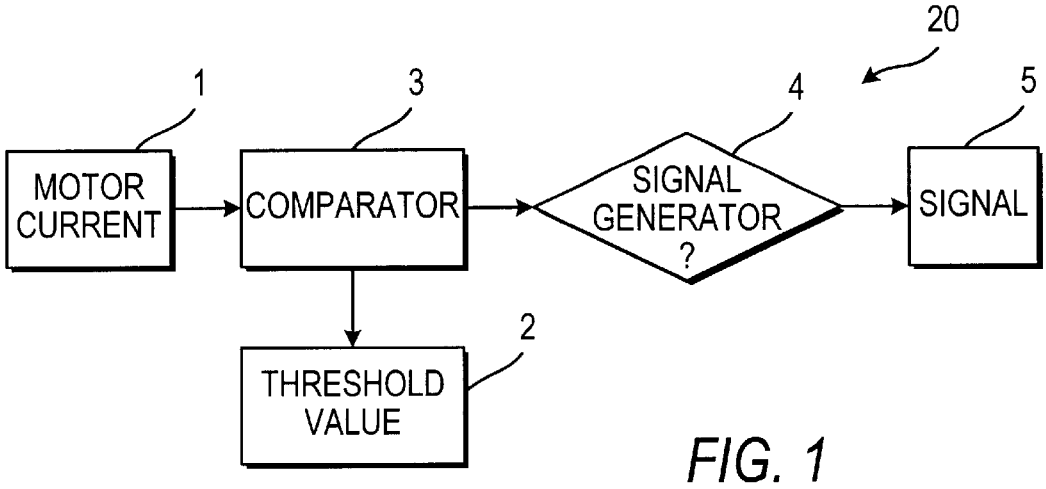
FIG. 1 is a block diagram of a first embodiment of the invention.

One embodiment of the apparatus for detection of an oil deficiency of oil lubricating an electrically driven cutting blade or blades of a haircutting machine (not shown in detail) is shown in FIG. 1. The motor current I (FIG. 2) is measured in operation (Block 1) and is compared with a predetermined temperature-dependent current threshold value (Block 2) by a comparator (Block 3). This threshold value 2 should be dependent on the environmental temperature, since the friction on the cutting blade or blades is influenced by it. If the measured motor current I, for example, does not drop at least for a short time (a few milliseconds) under the threshold value 2, a signal generator (Block 4) generates a signal (Block 5). Thus it is guaranteed that the signal 5 is not activated in normal cutting operation, however it is continuously turned on when the cutting knife is unoiled.

Figure 2:
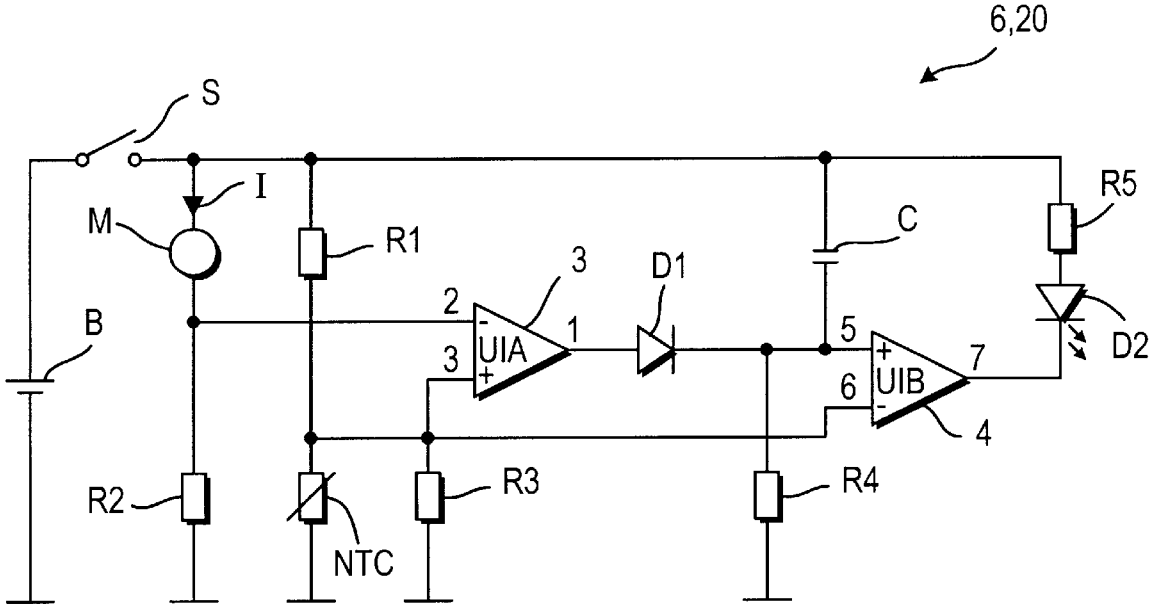
FIG. 2 is a schematic circuit diagram of the first embodiment of the invention.

After turning on (switch S) the haircutting machine 6 according to FIG. 2 a capacitor C is slowly charged via resistor R4. If the current I of the motor M drops under the threshold value determined by the resistors R1 and R3, the comparator 3 (U1A) switches or changes and the capacitor C is discharged through the diode D1. If the motor current I however does not drop below the threshold value at least for a short time, the capacitor C is completely charged, the signal generator 4 (U1B) switches and the light emitting diode D2 signals an oil deficiency. The NTC compensates for the temperature dependence of the blade friction values and the motor current I with the resistors R1 and R3.

Figure 3:
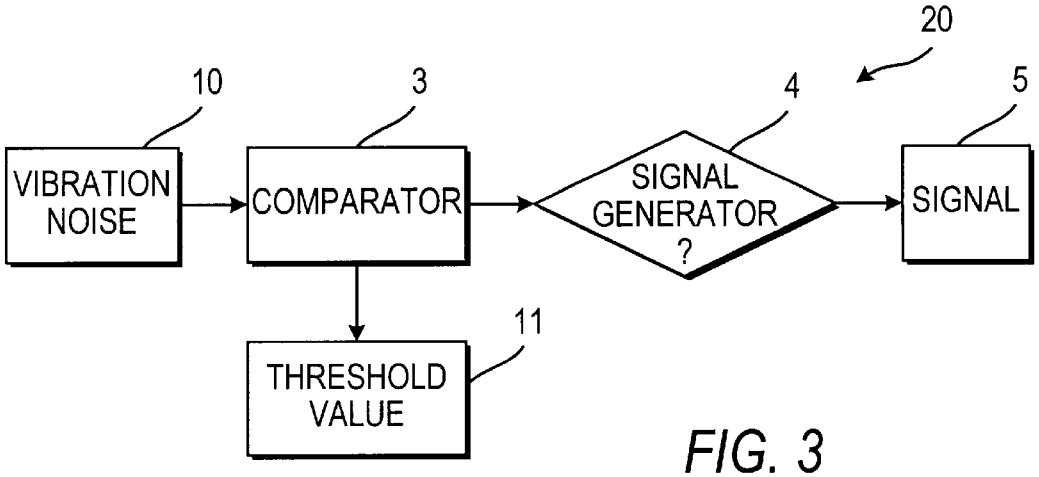
FIGS. 3 to 7 are block diagrams of a second to sixth embodiments of the invention.

An additional embodiment of the apparatus for detection of an oil deficiency of an electrically driven cutting blade of a haircutting machine is shown in FIG. 3. The cutting blade vibration noise (Block 10) is measured in operation—for example by means of a body sound sensor—and is compared with a predetermined vibration noise threshold value (Block 11) of a comparator (Block 3). For example if the measured cutting blade vibration noise 10 does not drop at least for a short time (e.g. 10 milliseconds) below the threshold value in a measurement period of e.g. 10 seconds, the signal generator 4 generates a signal 5.

Figure 4:
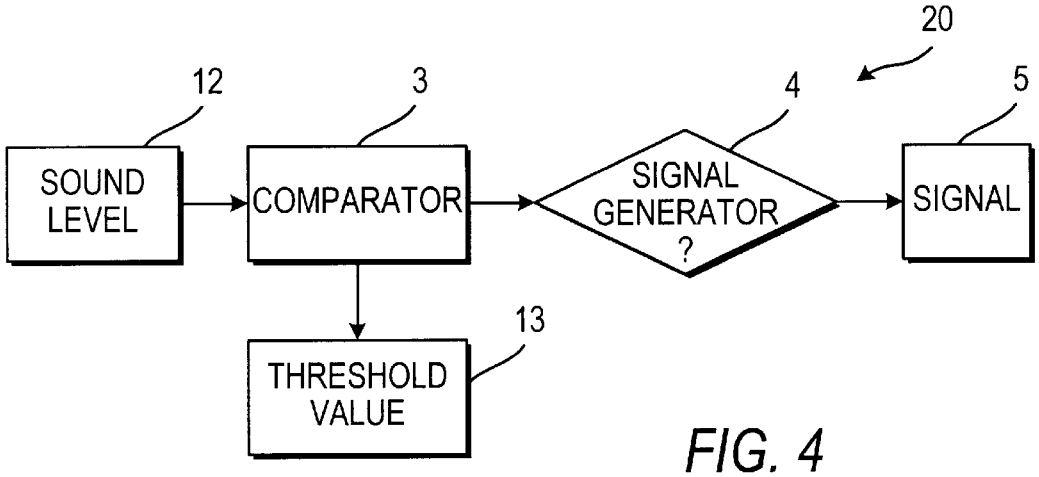

In the embodiment of FIG. 4 the sound level (Block 12) is measured in operation—for example with a microphone -▒ and is compared with a predetermined sound level threshold value (Block 13) by means of a comparator (Block 3) in order to detect an oil deficiency as indicated by a higher sound level generated by the haircutting machine. If, for example, the measured sound level in a measurement period of e.g. 10 seconds does not drop at least for a short time (e.g. for ten milliseconds) under the threshold value 13, a signal generator 4 produces a signal 5.

Figure 5:
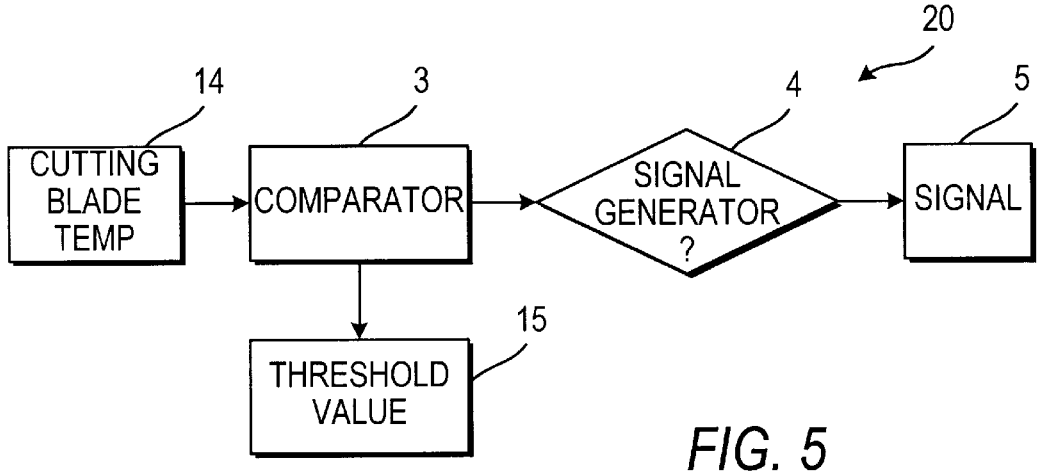

In the embodiment of FIG. 5 the cutting blade temperature is measured, for example, in the first minute after turning on the machine (Block 14)—for example by means of a suitable temperature sensor—and is compared with a predetermined environmental temperature dependent threshold value (Block 15) by a comparator (Block 3) in order to detect an oil deficiency. If, for example, the measured cutting blade temperature is higher than a predetermined temperature threshold value, a signal generator 4 generates a signal 5.

Figure 6:
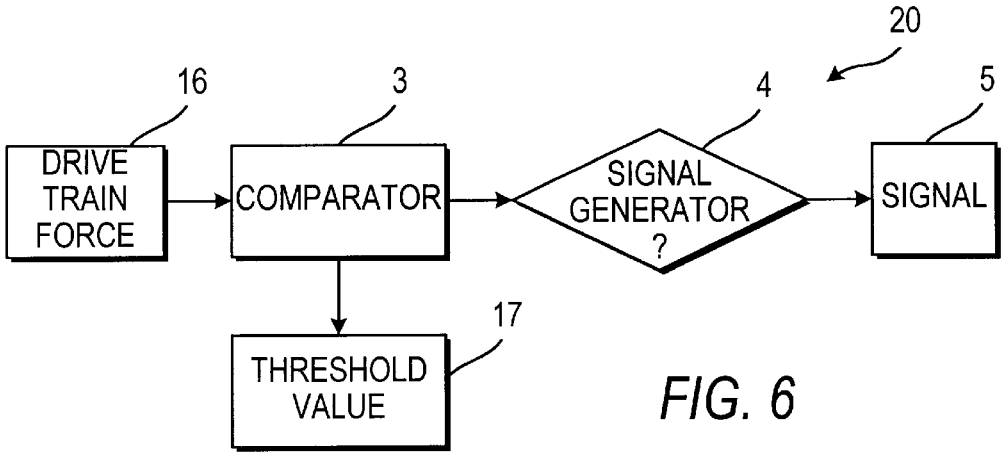

In the embodiment according to FIG. 6 for detecting an oil deficiency a force in the drive train between the drive shaft and the driven cutting blade is measured in operation (Block 16)—for example by means of a suitable pressure sensor (e.g. a resistance measuring bridge)—and is compared with a predetermined threshold value (Block 17) by a comparator (Block 3). Detection of a higher than normal force indicates an oil deficiency. If for example the measured force in a measurement period of for example 10 seconds does not drop at least for a short time (e.g. 10 milliseconds) under the threshold value 17, a signal generator 4 produces a signal 5 indicative of an oil deficiency.

Figure 7:
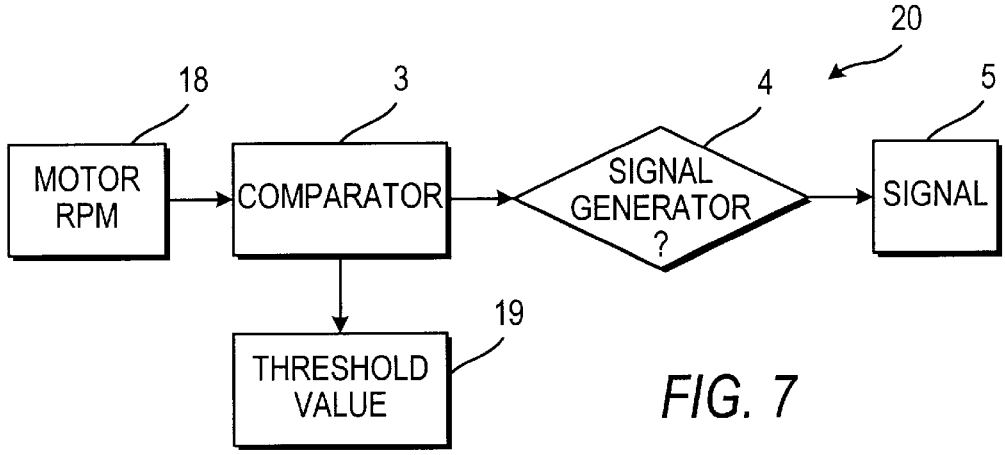

For detection of an oil deficiency in an embodiment according to FIG. 7 a motor rotation speed is measured in operation (Block 18)—for example by means of a suitable light barrier or the like—and is compared with a predetermined threshold value (Block 19) by a comparator (Block 3). If, for example, the measured motor rotation speed in a period or time interval of e.g. 10 seconds does not at least for short time (e.g. 10 milliseconds) drop below the threshold value 19, a signal generator 4 produces a signal 5.

Figure 8:
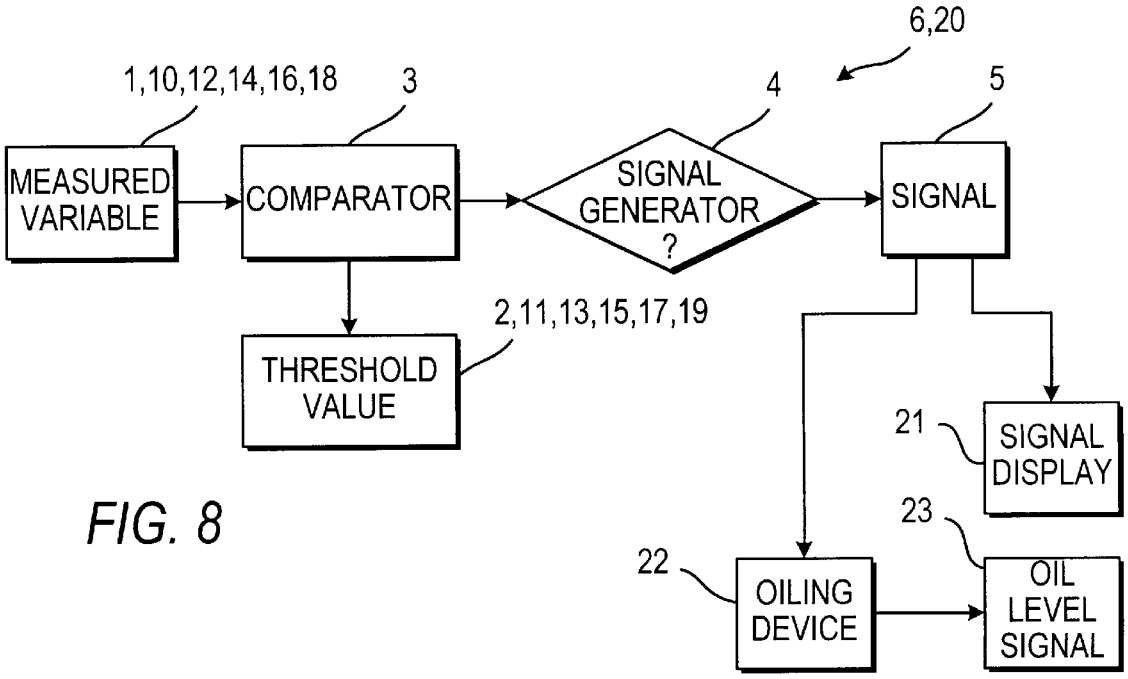
FIG. 8 is a block diagram of a haircutting machine with a signaling or display device, an oiling device and an oil level indicator.

In the embodiment shown in FIG. 8 the detection device 20 controlling a display device 21 for indicating the signal 5 of an oil deficiency is shown. The display can occur acoustically and/or optically. An oiling device 22 can be activated instead of the display device, whereby an automatic oiling of the cutting blade or blades occurs. The oiling device 22 is provided with an unshown oil reservoir, which is provided with an oil level signal device 23, which signals that the oil reservoir is filled with oil or not, and is dimensioned so that in professional usage of the haircutting machine it is only necessary to fill it with oil once a year.

The disclosure of German Patent Applications 197 10 267.0 of Mar. 13, 1997 and 197 17 055.2 of Apr. 23, 1997 is hereby explicitly incorporated by reference. These German Patent Applications disclose the same invention as described herein and claimed in the claims appended hereinbelow and is the basis for a claim of priority for the instant invention under 35 U.S.C. 119.

While the invention has been illustrated and described as embodied in a method and apparatus for detecting an oil deficiency of oil lubricating an electrically drive cutting blade in a haircutting machine, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

We claim:

1. An electric haircutting machine comprising a plurality of cutting blades, an electrical drive motor for driving the cutting blades, means (22) for oiling said cutting blades and means (20) for detecting an oil deficiency of oil lubricating the cutting blades of the haircutting machine, wherein said means (22) for oiling said cutting blades is connected with and responsive to said means (20) for detecting the oil deficiency, whereby said means for oiling said cutting blades is automatically activated to oil said cutting blades when said oil deficiency is detected.

2. The electrical haircutting machine as defined in claim 1, further comprising a signaling device (21) for signaling the oil deficiency when the oil deficiency is detected by the means (20) for detecting.

3. The haircutting machine as defined in claim 2, further comprising an oil reservoir connected with the means (22) for oiling to supply the means for oiling with the oil and an oil level indicator (23) for the oil reservoir.

4. The haircutting machine as defined in claim 1, wherein said means for detecting the oil deficiency comprises means for measuring a measurable variable of said haircutting machine and means for determining whether or not said measurable variable is above or below a predetermined threshold value, wherein said measurable variable is selected from the group consisting of a motor current consumption, a cutting blade vibration noise, a haircutting machine sound level, a cutting blade temperature, a force acting on one of the cutting blades and a drive motor rotation speed.

* * * * *